US011545080B2

(12) United States Patent
Yu

(10) Patent No.: US 11,545,080 B2
(45) Date of Patent: Jan. 3, 2023

(54) GATE DRIVER AND ELECTROLUMINESCENCE DISPLAY DEVICE USING THE SAME

(71) Applicant: LG Display Co., Ltd., Seoul (KR)

(72) Inventor: JaeSung Yu, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/588,342

(22) Filed: Jan. 31, 2022

(65) Prior Publication Data

US 2022/0157227 A1 May 19, 2022

Related U.S. Application Data

(62) Division of application No. 16/517,921, filed on Jul. 22, 2019, now Pat. No. 11,270,629.

(30) Foreign Application Priority Data

Jul. 31, 2018 (KR) ..... 10-2018-0089163

(51) Int. Cl.
*G09G 3/3266* (2016.01)
*G09G 3/32* (2016.01)

(52) U.S. Cl.
CPC ..... *G09G 3/32* (2013.01); *G09G 3/3266* (2013.01); *G09G 2300/08* (2013.01);
(Continued)

(58) Field of Classification Search
None
See application file for complete search history.

(56) References Cited

U.S. PATENT DOCUMENTS 9,230,482 B2 1/2016 Lee et al.
2005/0018807 A1* 1/2005 Han ..... G11C 8/04 377/69

(Continued)

FOREIGN PATENT DOCUMENTS

CN 103714792 A 4/2014
CN 105405417 A 3/2016

(Continued)

OTHER PUBLICATIONS

Office Action dated Oct. 15, 2021, issued in corresponding Chinese Patent Application No. 201910665667.6. (English translation submitted in the parent application).

(Continued)

*Primary Examiner* — Parul H Gupta
(74) *Attorney, Agent, or Firm* — Morgan, Lewis & Bockius LLP

(57) ABSTRACT

A disclosed gate driver includes a plurality of stages, a $k^{th}$ stage comprising: a first output node connected to an emission line; a second output node; a Q node connected to a first controller and a pull-down circuit; the pull-down circuit and a pull-up circuit respectively controlled by the Q node and the second output node; the first controller configured to receive a voltage of a first output node of a $(k-1)^{th}$ stage or a first start signal; a second controller configured to receive a voltage of a second output node of the $(k-1)^{th}$ stage or a second start signal; a third controller configured to control the voltage of the second output node; and a fourth controller configured to be controlled by the second output node and to control the voltage of the first output node, wherein 'k' is a natural number ≥1.

12 Claims, 5 Drawing Sheets

(52) U.S. Cl.
CPC . *G09G 2310/0286* (2013.01); *G09G 2310/08* (2013.01); *G09G 2320/0626* (2013.01)

(56) References Cited

U.S. PATENT DOCUMENTS

| | | | | |
|---|---|---|---|---|
| 2011/0285675 | A1 | 11/2011 | Amano et al. | |
| 2012/0140052 | A1* | 6/2012 | Baek | G09G 3/3688 348/51 |
| 2014/0071114 | A1 | 3/2014 | Kim et al. | |
| 2016/0019833 | A1 | 1/2016 | Wei et al. | |
| 2016/0071614 | A1 | 3/2016 | Lee | |
| 2016/0086562 | A1 | 3/2016 | Tan et al. | |
| 2016/0224175 | A1* | 8/2016 | Moon | G06F 3/0412 |
| 2016/0358666 | A1 | 12/2016 | Pang | |
| 2017/0154565 | A1 | 6/2017 | Qing et al. | |
| 2017/0338818 | A1* | 11/2017 | Harada | H03K 19/1778 |
| 2017/0365211 | A1 | 12/2017 | Lee et al. | |
| 2018/0005573 | A1 | 1/2018 | Kim et al. | |
| 2018/0033388 | A1 | 2/2018 | Gong | |
| 2018/0114482 | A1 | 4/2018 | Jung | |
| 2018/0122323 | A1 | 5/2018 | Park et al. | |
| 2018/0144711 | A1 | 5/2018 | Noh et al. | |
| 2018/0151125 | A1* | 5/2018 | Lee | G09G 3/3266 |
| 2018/0151146 | A1 | 5/2018 | Chang et al. | |
| 2018/0190197 | A1 | 7/2018 | Chang et al. | |
| 2018/0190205 | A1 | 7/2018 | Choi | |
| 2019/0005884 | A1* | 1/2019 | Yoo | G06F 3/011 |
| 2021/0201832 | A1* | 7/2021 | Lim | G09G 3/3291 |

FOREIGN PATENT DOCUMENTS

| | | | |
|---|---|---|---|
| CN | 105632410 | A | 6/2016 |
| CN | 107527589 | A | 12/2017 |
| CN | 107564472 | A | 1/2018 |
| CN | 108010494 | A | 5/2018 |
| CN | 108122523 | A | 6/2018 |
| CN | 108122542 | A | 6/2018 |
| CN | 108257549 | A | 7/2018 |
| JP | 2000-155550 | A | 6/2000 |
| JP | 2012-009125 | A | 1/2012 |
| JP | 2015-515642 | A | 5/2015 |
| JP | 2017-120406 | A | 11/2017 |
| JP | 2018-072825 | A | 5/2018 |
| KR | 10-2013-0016496 | A | 2/2013 |
| KR | 10-2013-0051340 | A | 5/2013 |
| KR | 10-2015-0069773 | A | 6/2015 |
| KR | 10-2018-0036449 | A | 4/2018 |
| KR | 10-2018-0057776 | A | 5/2018 |
| KR | 10-2018-0079087 | A | 7/2018 |
| TW | 201735001 | A | 10/2017 |

OTHER PUBLICATIONS

Office Action dated Aug. 27, 2020, issued in corresponding Japanese Patent Application No. 2019-140444 (English translation submitted in the parent application).
Office Action dated May 29, 2020, issued in corresponding Taiwanese Patent Application No. 108125296. (English translation submitted in the parent application).

* cited by examiner

GATE DRIVER AND ELECTROLUMINESCENCE DISPLAY DEVICE USING THE SAME

CROSS-REFERENCE TO RELATED APPLICATION(S)

This application is a divisional of co-pending U.S. patent application Ser. No. 16/517,921, filed on Jul. 22, 2019, which claims the benefit of and priority to Korean Patent Application No. 10-2018-0089163, filed on Jul. 31, 2018. All of the above prior U.S. and Korean patent applications are hereby incorporated by reference in their entirety.

BACKGROUND

1. Technical Field

The present disclosure relates to a gate driver and an electroluminescence display device using the same, and more particularly, to a gate driver having an improved driving capacity and an electroluminescence display device using the same.

2. Discussion of the Related Art

With the advancement of information technology, the market for a display device that is a connection medium between a user and information has increased. Therefore, use of various types of display devices, such as an electroluminescence display device, a liquid crystal display (LCD) device, an organic light-emitting display (OLED) device, and a quantum dot light-emitting display (QLED) device, has increased.

Among the display devices, the electroluminescence display device has advantages in that a response speed is fast, luminance efficiency is high, and a viewing angle is wide. Generally, the electroluminescence display device applies a data voltage to a gate electrode of a driving transistor using a transistor that is turned on by a scan signal and charges the data voltage supplied to the driving transistor in a storage capacitor. The electroluminescence display device allows a light-emitting diode to emit light by outputting the data voltage charged in the storage capacitor using a light-emitting control signal. The light-emitting diode may include an organic light-emitting diode and an inorganic light-emitting diode.

A gate signal and a data signal are supplied to the electroluminescence display device, and the gate signal includes a scan signal and an emission signal. The electroluminescence display device is driven using the emission signal and one or more scan signals. Generally, a gate driver that generates a scan signal may include a shift register for sequentially outputting gate signals.

A display panel, which is a basic device for displaying an image, may be categorized into a display area in which a pixel array is arranged and an image is displayed, and a non-display area in which an image is not displayed. The gate driver is attached to the display panel in the form of a chip-on-film (COF) or chip-on-glass (COG), or is realized in the form of a gate-in-panel (GIP) formed by combination of thin-film transistors in a bezel area, which is a non-display area of the display panel. The GIP-type gate driver includes stages corresponding to the number of gate lines, wherein each stage outputs a gate pulse supplied to gate lines to which the stages correspond one-to-one. The gate line supplies the gate signal to the pixel array arranged in the display area to allow the light-emitting diode to emit light. Therefore, a method for improving a driving capacity and reliability of a gate driver to transfer an exact signal to a pixel array has been studied.

As described above, the electroluminescence display device is driven using an emission signal and one or more scan signals. To drive the electroluminescence display device, a scan signal for scanning a data signal and an emission signal for suspending luminescence of a light-emitting diode are required.

An operation margin (e.g., operation range) is reduced due to increase of load of a clock signal and an emission signal according to high resolution of the display panel, and a defect of an emission driving circuit may occur. Also, the GIP-type gate driver increases a size of a bezel area of the electroluminescence display device.

SUMMARY

Accordingly, the present disclosure is directed to a gate driver and an electroluminescence display device using the same that substantially obviate one or more of the issues due to limitations and disadvantages of the related art.

An aspect of the present disclosure is to provide a gate driver and a display device using the same, in which a size of a bezel area of a display panel may be reduced.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided an electroluminescence display device, including: an emission line, subpixels connected to the emission line, and an emission driver configured to supply an emission signal to the emission line, the emission driver including a plurality of stages, a $k^{th}$ stage, among the plurality of stages, including: a first output node connected to the emission line, a second output node, a Q node, a pull-down circuit and a pull-up circuit respectively controlled by the Q node and the second output node, the pull-down circuit and the pull-up circuit being configured to provide a voltage to the first output node, a first controller configured to receive a voltage of a first output node of a $(k-1)^t$ stage, among the plurality of stages, or a first start signal, a second controller configured to receive a voltage of a second output node of the $(k-1)^t$ stage, among the plurality of stages, or a second start signal, a third controller configured to control the voltage of the second output node, and a fourth controller configured to be controlled by the second output node, wherein 'k' is a natural number of 1 or more.

In another aspect, there is provided a gate driver, including: a plurality of stages, a $k^{th}$ stage, among the plurality of stages, including: a first output node, a second output node, a pull-down transistor and a pull-up transistor configured to control the first output node, a controller configured to control the second output node, the controller including: a T3 transistor configured to be controlled by a Q node, a T4 transistor configured to be controlled by a first clock signal, a T5 transistor configured to be controlled by a QB node, and a first capacitor including: a first electrode connected to the QB node, and a second electrode connected to the second output node, and an output signal stabilizer connected to the Q node and the second output node, wherein voltages applied to the first output node and the second output node are applied as start signals of a $(k+1)^{th}$ stage, and wherein 'k' is a natural number of 1 or more.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

Figure 1:
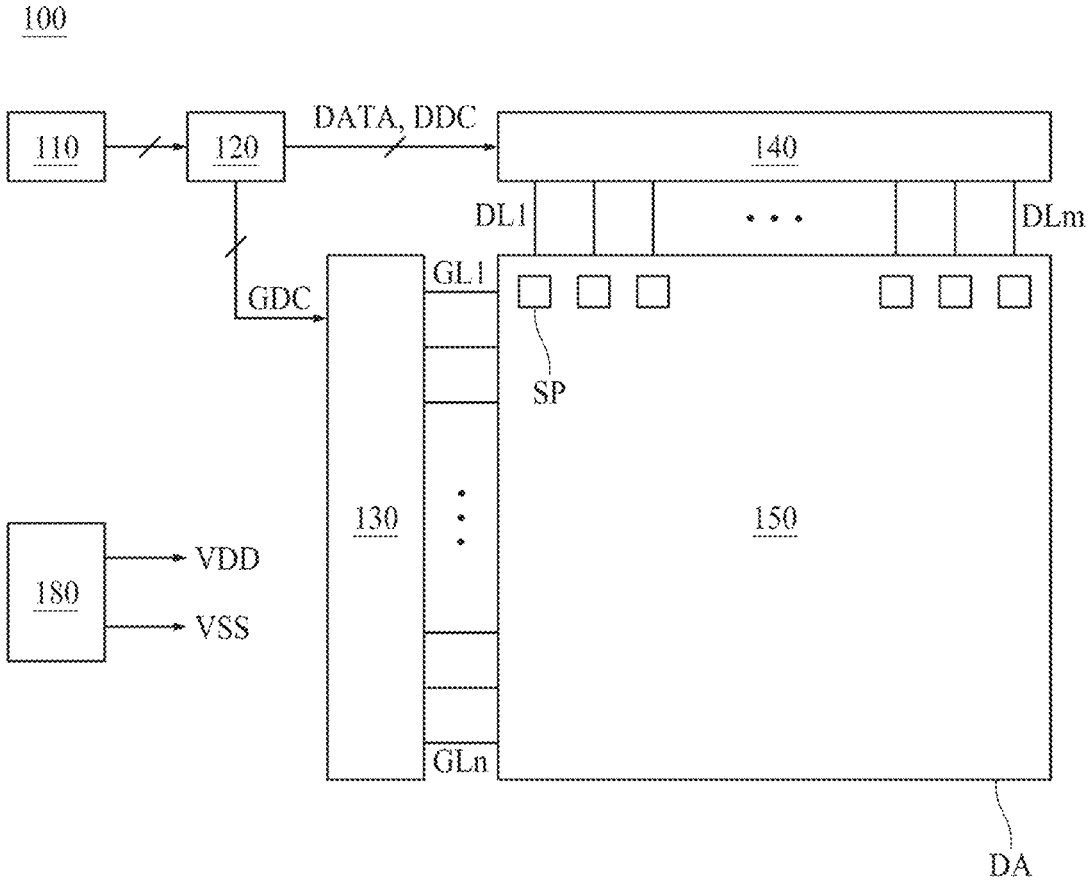
FIG. 1 is a block diagram illustrating an electroluminescence display device according to an example embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

It will be understood that, although the terms "first," "second," etc. May be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and embodiments of the present disclosure are not limited thereto.

The terms "first horizontal axis direction," "second horizontal axis direction," and "vertical axis direction" should not be interpreted only based on a geometrical relationship in which the respective directions are perpendicular to each other, and may be meant as directions having wider directivities within the range within which the components of the present disclosure can operate functionally.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

In the present disclosure, a gate driver on a substrate of a display panel may be implemented with an n-type or p-type transistor. For example, the transistor may be implemented with a transistor having a metal oxide semiconductor field effect transistor (MOSFET) structure. The transistor may be a three-electrode device, including a gate electrode, a source electrode, and a drain electrode. The source electrode may supply a carrier to the transistor. In the transistor, the carrier may start to move from the source. The drain electrode may be an electrode through which the carrier may move from the transistor to the outside.

For example, in the transistor, the carrier may move from the source electrode to the drain electrode. In an n-type transistor, because the carrier is an electron, a voltage of the source electrode is lower than a voltage of the drain electrode for the electron to move from the source electrode to the drain electrode. In the n-type transistor, because the electron moves from the source electrode to the drain electrode, a current moves from the drain electrode to the source electrode. In a p-type transistor, because the carrier is a hole, the voltage of the source electrode is higher than the voltage of the drain electrode for the hole to move from the source electrode to the drain electrode. In the p-type transistor, because the hole moves from the source electrode to the drain electrode, a current moves from the source electrode to the drain electrode. The source electrode and the drain electrode of the transistor may not be fixed, and may be switched in accordance with an applied voltage. Therefore, the source electrode and the drain electrode may respectively be referred to as a "first electrode" and a "second electrode" or the "second electrode" and the "first electrode."

Hereinafter, a gate-on voltage may be a voltage of a gate signal for turning on a transistor. A gate-off voltage may be a voltage for turning off the transistor. For example, in a p-type transistor, the gate on voltage may be a logic low voltage VL, and the gate off voltage may be a logic high voltage VH. In an n-type transistor, the gate on voltage may be a logic high voltage, and the gate off voltage may be a logic low voltage. Hereinafter, a gate driver and an electroluminescence display device using the same according to the present disclosure will be described with reference to the accompanying drawings.

The inventors of the present disclosure have recognized the aforementioned problems and have invented a gate driver and an electroluminescence display device using the same, in which the gate driver may be arranged in a small area and an operation margin (e.g., operation range) and reliability are improved.

Hereinafter, a gate driver and an electroluminescence display device using the same according to an embodiment of the present disclosure will be described in detail with reference to the accompanying drawings.

FIG. 1 is a block diagram illustrating an electroluminescence display device according to an example embodiment of the present disclosure.

With reference to FIG. 1, the electroluminescence display device 100 may include an image processor 110, a timing controller 120, a gate driver 130, a data driver 140, a display panel 150, and a power supply unit 180. The image processor 110 may output driving signals for driving various kinds of devices along with externally supplied image data. The driving signals outputted from the image processor 110 may include a data enable signal, a vertical synchronization signal, a horizontal synchronization signal, and a clock signal.

The timing controller 120 may receive the image data and the driving signals, etc. from the image processor 110. The timing controller 120 may output a gate timing control signal GDC for controlling the operation timing of the gate driver 130, a data timing control signal DDC for controlling the operation timing of the data driver 140, and a data signal DATA including luminance information of an image to be displayed on the display panel 150, based on the driving signals.

The gate driver 130 may output scan signals in response to the gate timing control signal GDC supplied from the timing controller 120. The gate driver 130 may output gate signals through gate lines GL1 to GLn. The gate driver 130 may be provided in the form of an IC (integrated circuit), or may be provided in the form a gate-in-panel (GIP) built in the display panel 150. The gate driver 130 may be at each of left and right sides of the display panel 150, or may be at one side of the left and right sides, although embodiments are not limited to these sides. The gate driver 130 may include a plurality of stages. For example, a first stage of the gate driver 130 may output a first gate signal to be applied to a first gate line of the display panel 150.

The data driver 140 may output data voltages in response to the data timing control signal DDC supplied from the timing controller 120. The data driver 140 may sample and latch a digital data signal DATA supplied from the timing controller 120, and may convert the digital data signal DATA into an analog data signal based on a gamma reference voltage. The data driver 140 may output data signals through data lines DL1 to DLm. The data driver 140 may be provided on the display panel 150 in the form of an IC (integrated circuit), or may be provided on the display panel 150 in the form of a chip-on-film (COF).

The power supply unit 180 may output a high potential power voltage VDD and a low potential power voltage VSS. The high potential power voltage VDD and the low potential power voltage VSS output from the power supply unit 180 may be supplied to the display panel 150. The high potential power voltage VDD may be supplied to the display panel 150 through a high potential power line, and the low potential power voltage VSS may be supplied to the display panel 150 through a low potential power line. The voltages outputted from the power supply unit 180 may be used by the gate driver 130 or the data driver 140.

The display panel 150 may display an image in response to the gate signals and the data signals respectively supplied from the gate driver 130 and the data driver 140, and the power voltage supplied from the power supply unit 180. The display panel 150 may include a pixel array operating to display an image, and the pixel array may include a plurality of subpixels SP.

The display panel 150 may include a display area DA in which the subpixels SP may be arranged, and a non-display area in which various signal lines or pads may be formed outside the display area DA. Because the display area DA is an area in which an image is displayed, the subpixels SP may be in the display area. Because the non-display area is an area in which an image is not displayed, the subpixels SP may not be in the non-display area, but dummy pixels may be provided therein. Also, the gate driver 130 and the data driver 140 may be in the non-display area.

The display area DA may include a plurality of subpixels SP, and may display an image based on gray displayed by each subpixel SP. Each subpixel SP may be connected with a data line DL arranged along a column line, and may be connected to a gate line arranged along a pixel line or a row line. The subpixels SP on a same pixel line may be driven simultaneously while sharing a same gate line. When the subpixels SP connected to the first gate line are defined as "first subpixels" and the subpixels SP connected to the $n^{th}$ gate line are defined as "$n^{th}$ subpixels," the first subpixels to the $n^{th}$ subpixels may be driven sequentially.

The subpixels SP may be arranged in the form of matrix to constitute a pixel array, but embodiments are not limited to this case. For example, the subpixels SP may be arranged in various forms, such as a form sharing subpixels SP, a stripe form, and a diamond form, in addition to the matrix form.

The subpixels SP may include red subpixels, green subpixels, and blue subpixels, or may include red subpixels, green subpixels, blue subpixels, and white subpixels. The subpixels SP may have one or more different light-emission areas, depending on the light-emission characteristics.

Figure 2:
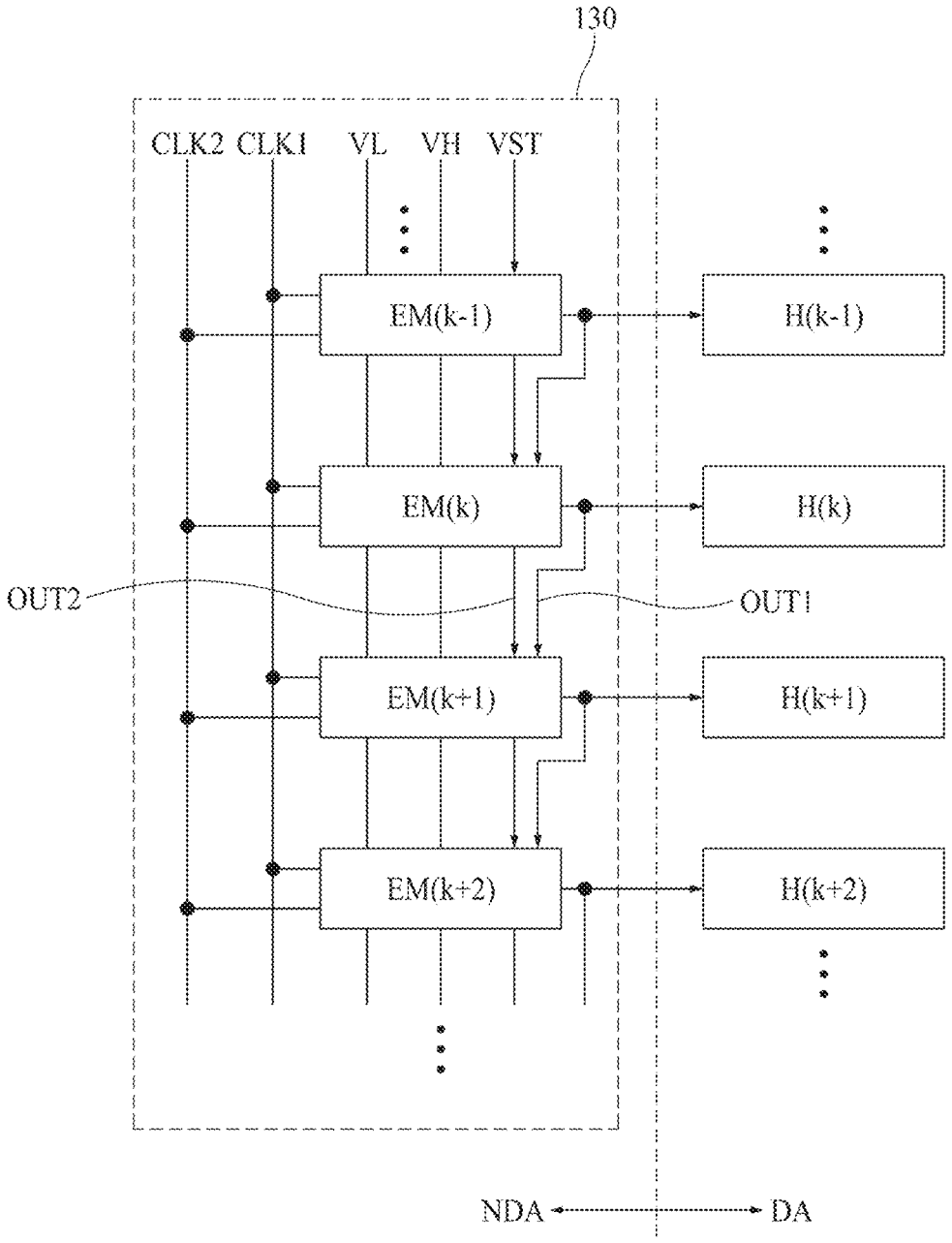
FIG. 2 is a block diagram illustrating a gate driver according to an example embodiment of the present disclosure.

FIG. 2 is a block diagram illustrating a gate driver according to an example embodiment of the present disclosure.

For example, FIG. 2 shows a pixel line to which signals output from the gate driver and the gate driver according to an example embodiment of the present disclosure may be applied. As described above, the display panel 150 may include a display area DA in which an image may be displayed based on subpixels SP, and a non-display area NDA in which a signal line or driver may be provided and an image may not be displayed.

The subpixel may include a light-emitting diode and a pixel driving circuit for controlling the amount of a current applied to an anode of the light-emitting diode. The pixel driving circuit may include a driving transistor for controlling the amount of a current to flow a certain current to the light-emitting diode. The light-emitting diode may emit light for a light-emitting period, and may not emit light for the other period. For the period other than the light-emitting period, the pixel driving circuit may be initiated, a scan signal may be input to the pixel driving circuit, and programming and a pixel driving circuit compensation period may be performed. For example, compensation of the pixel driving circuit may be compensation of a threshold voltage of the driving transistor. Because a current for allowing the light-emitting diode to emit light at specific luminance is not uniformly supplied for the period other than the light-emitting period, the light-emitting diode may not emit light. For example, as a method for not allowing the light-emitting diode to emit light, an emission transistor may be connected between the anode of the light-emitting diode and the driving transistor. The emission transistor may be connected to an emission line, and may be controlled by an emission signal output from an emission driver. For the light-emitting period, the emission signal may be a turn-on voltage, and for the period other than the light-emitting period, the emission signal may be a turn-off voltage.

A gate signal for driving the subpixels SP included in the display panel 150 may include a scan signal and an emission signal. Therefore, the gate driver 130 may separately include a driving portion for applying a scan signal and a driving portion for applying an emission signal. The scan signal may be applied to the subpixels SP through a scan line, and the emission signal may be applied to the subpixels through the emission line.

The gate driver 130 of FIG. 2 may display only the driving portion for applying an emission signal. The gate driver 130 according to the present disclosure may include a first stage EM(1) to an $n^{th}$ stage EM(n). In FIG. 2, a $k^{th}$ stage EM(k) will be described as an example. In this case, "k" is a natural number and $1<k\leq n$.

The gate driver 130 may include lines to which a first clock signal CLK1 input to the $k^{th}$ stage EM(k), a second clock signal CLK2, a low voltage VL, a high voltage VH, and a start voltage VST may be respectively applied. For example, the low voltage VL may be −8 V to −7 V, and an emission high voltage VH may be 7 V to 8 V. The $k^{th}$ stage EM(k) may provide an emission signal to a $k^{th}$ pixel line H(k) while shifting a start voltage VST to correspond to the first clock signal CLK1 and the second clock signal CLK2. For example, the start voltage VST may be input to a first stage EM(1), and a second stage EM(2) to the $n^{th}$ stage EM(n) may operate by receiving the emission signal output from their respective previous stage as a start signal. For example, a first output signal OUT1 of the $k^{th}$ stage EM(k) may be input to the start signal of a $(k+1)^{th}$ stage EM(k+1) and the $k^{th}$ pixel line H(k). The $(k+1)^{th}$ stage EM(k+1) may provide an emission signal to a $(k+1)^{th}$ pixel line H(k+1). A second output signal OUT2 of the $k^{th}$ stage EM(k) may be input to the start signal of the $(k+1)^{th}$ stage EM(k+1). The $(k+1)^{th}$ stage EM(k+1) may use two signals output from the $k^{th}$ stage EM(k) as the start signals, and an area reserved by the stage may be reduced to reduce a bezel area and an operation margin (e.g., operation range) of elements included in the stage may be enhanced. Similarly, a $(k+2)^{th}$ stage EM(k+2) may use two signals output from the $k^{th}$ stage $(k+1)^{th}$ stage EM(k+1) as the start signals. The $(k+2)^{th}$ stage EM(k+2) may provide an emission signal to a $(k+2)^{th}$ pixel line H(k+2).

The first clock signal CLK1 and the second clock signal CLK2 may swing between the high voltage and the low voltage, and may have phases opposite to each other. For example, although the first clock signal CLK1 and the second clock signal CLK2 may have phases opposite to each other, there may be a difference in a clock period therebetween. For example, the clock period of the first clock signal CLK1 may be longer than that of the second clock signal CLK2. FIG. 2 shows, but embodiments are not limited to, a two-phase circuit of the first clock signal CLK1 and the second clock signal CLK2 input to the gate driver 130.

Figure 3:
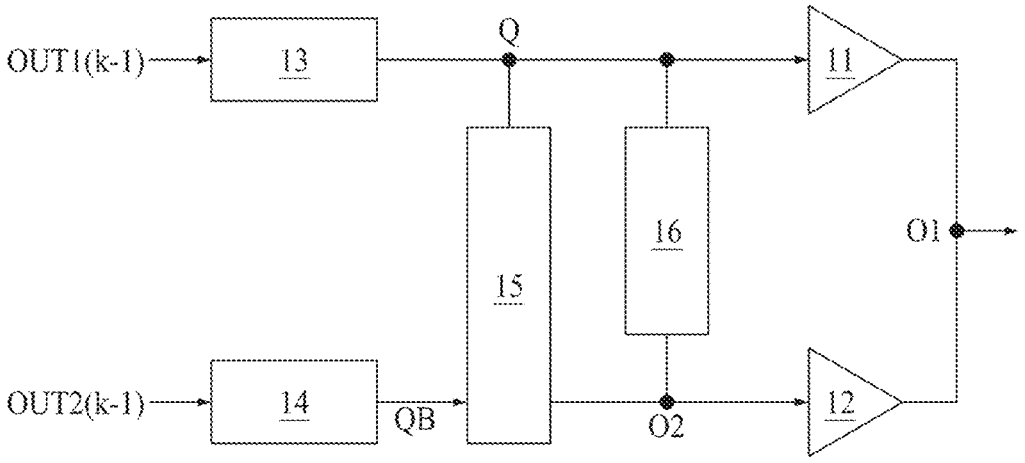
FIG. 3 is a block diagram illustrating a stage according to an example embodiment of the present disclosure.

FIG. 3 is a block diagram illustrating a stage according to an example embodiment of the present disclosure.

In FIG. 3, the $k^{th}$ stage EM(k) constituting the gate driver 130 will be described as an example. In this case, the stage may be an emission stage. With reference to FIG. 3, the $k^{th}$ stage EM(k) may include a pull-down unit (e.g., circuit) 11, a pull-up unit (e.g., circuit) 12, a Q node controller 13, a QB node controller 14, an O2-node controller 15, and an output signal stabilizer 16.

The pull-down unit 11 may output a first output signal OUT1 in response to a voltage of a Q node Q. The pull-up unit 12 may control the first output signal OUT1 by a turn-off voltage in response to the voltage of an O2-node O2. The first output signal OUT1 may be applied to an O1-node O1 and the $k^{th}$ pixel line. The O2-node will be described later. The Q node may be referred to as a "first node," the O2-node may be referred to as a "second node," and the O1-node may be referred to as a "third node."

The Q node controller 13 may be an element for charging or discharging the Q node Q, and may apply a turn-on voltage to the Q node Q by using the first output signal OUT1($k$−1) of the $(k-1)^{t}$ stage EM(k−1) as a start signal. The $(k-1)^{th}$ stage EM(k−1) may provide an emission signal to the $(k-1)^{th}$ pixel line H(k−1). The Q node controller 13 may be referred to as a "first controller."

The QB node controller 14 may be an element for charging or discharging the QB node QB, and may apply a turn-on voltage to the QB node QB by using the second output signal OUT2($k$−1) of the $(k-1)^{th}$ stage EM(k−1) as a start signal. The QB node controller 14 may be referred to as a "second controller."

The O2-node controller 15 may be an element for charging or discharging the O2-node O2, may receive a signal applied to the QB node QB, and may output the signal to the O2-node O2. The O2-node controller 15 may output the turn-on voltage to the O2-node O2 when the Q node Q is a turn-off voltage, and may output the turn-off voltage to the O2-node O2 when the Q node Q is a turn-on voltage. If a voltage of the Q node Q is a low voltage, the O2-node controller 15 may maintain the voltage of the O2-node O2 at a high voltage. The O2-node controller 15 may be referred to as a "third controller."

The output signal stabilizer 16 may stabilize the first output signal OUT1 by maintaining the voltage of the Q node Q at a high voltage in accordance with the voltage of the O2-node O2. The output signal stabilizer 16 may be referred to as a "fourth controller."

As described above, the turn-off voltage may vary, depending on types of transistors to which the turn-off voltage may be applied. The turn-off voltage may be a high voltage in the case of a p-type transistor, and may be a low voltage in the case of an n-type transistor. The turn-on voltage is a low voltage in case of a p-type transistor, and is a high voltage in case of an n-type transistor. Hereinafter, a $k^{th}$ stage EM(k) included in a p-type transistor will be described as an example.

Figure 4:
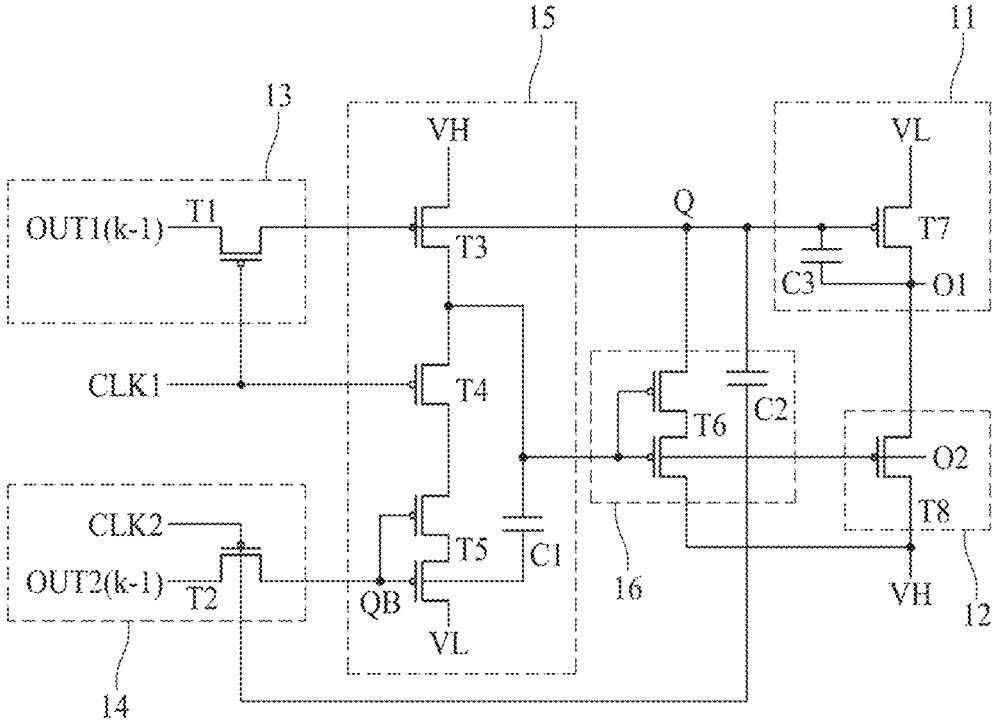
FIG. 4 is a circuit diagram illustrating a stage according to an example embodiment of the present disclosure.

FIG. 4 is a circuit diagram illustrating a stage according to an example embodiment of the present disclosure.

FIG. 4 is a detailed circuit diagram of an example of the block diagram of FIG. 3. The $k^{th}$ stage EM(k) constituting the gate driver 130 will be described as an example with reference to FIG. 4. With reference to FIG. 4, the $k^{th}$ stage EM(k) may include a pull-down unit 11, a pull-up unit 12, a Q node controller 13, a QB node controller 14, an O2-node controller 15, and an output signal stabilizer 16.

The Q node controller 13 may include a first transistor T1. A gate electrode of the first transistor T1 may be connected to a first clock signal line to which the first clock signal CLK1 may be input, a source electrode of the first transistor T1 may be connected to a first output node of the $(k-1)^{th}$ stage, and a drain electrode of the first transistor T1 may be connected to the Q node Q. The first transistor T1 may be turned on by the turn-on voltage of the first clock signal CLK1 to provide the first output signal OUT1($k$−1) of the $(k-1)^{th}$ stage to the Q node Q.

The QB node controller 14 may include a second transistor T2. A gate electrode of the second transistor T2 may be connected to a second clock signal line to which the second clock signal CLK2 is input, a source electrode of the second transistor T2 may be connected to a second output node of the $(k-1)^{t}$ stage, and a drain electrode of the second transistor T2 may be connected to the QB node QB. The second transistor T2 may be turned on by the turn-on voltage of the second clock signal CLK2 to provide the second output signal OUT2($k$−1) of the $(k-1)^{th}$ stage to the QB node QB.

The O2-node controller 15 may include a third transistor T3, a fourth transistor T4, and a fifth transistor T5. The third transistor T3, the fourth transistor T4, and the fifth transistor T5 may be serially connected to one another. A drain electrode of the third transistor T3 may be connected to a drain electrode of the fourth transistor T4, and a source electrode of the fourth transistor T4 may be connected to a source electrode of the fifth transistor T5. A gate electrode of the third transistor T3 may be connected to a gate electrode of the first transistor T1, a gate electrode of the fourth transistor T4 may be connected to the first clock signal line, and a gate electrode of the fifth transistor T5 may be connected to the QB node QB. A source electrode of the third transistor T3 may be connected to a high voltage line to which the high voltage VH may be input, and a source electrode of the fifth transistor T5 may be connected to a low voltage line to which the low voltage VL may be input.

When voltages of the first clock signal CLK1 and the QB node QB are turn-on voltages, the low voltage VL may be applied to the O2-node O2. The voltage applied to the O2-node O2 may become a start signal of the $(k+1)^{th}$ stage. For example, the fifth transistor T5, to which stress higher than those of the other transistors may be applied, may be connected to a first capacitor and may be a double-gate type transistor, and reliability of the fifth transistor T5 may be improved.

The O2-node controller 15 may further include a first capacitor C1. A first electrode of the first capacitor C1 may be connected to the O2-node O2, and a second electrode of the first capacitor C1 may be connected to the QB node QB. The first capacitor C1 may allow the voltage of the QB node QB to be lower than the low voltage VL by bootstrapping when the low voltage VL is applied to O2-node O2, and the fifth transistor T5 may stably be maintained at a turn-on state. The third transistor T3 may be turned on when the low voltage is provided to the Q node Q, and thus may apply the high voltage VH to the O2-node O2.

The output signal stabilizer 16 may include a sixth transistor T6. A gate electrode of the sixth transistor T6 may be connected to the O2-node O2, a source electrode of the sixth transistor T6 may be connected to a high voltage line to which the high voltage VH may be input, and a drain electrode of the sixth transistor T6 may be connected to the Q node Q. If the low voltage is applied to the O2-node O2, the sixth transistor T6 may be turned on, and thus the sixth transistor T6 may apply the high voltage to the Q node Q. The sixth transistor T6 may turn off the pull-down unit 11, and may allow the turn-off voltage to be stably maintained in the O1-node O1. The sixth transistor T6, to which stress higher than those of the other transistors may be applied, may be connected to the first capacitor, and may be a double-gate type transistor, and reliability of the sixth transistor T6 may be improved.

The output signal stabilizer 16 may further include a second capacitor C2. A first electrode of the second capacitor C2 may be connected to the Q node Q, and a second electrode of the second capacitor C2 may be connected to the second clock signal line. The second capacitor C2 may maintain a voltage of the Q node Q as a low voltage by a charge pumping action when the Q node Q is a low voltage.

The pull-down unit 11 may include a seventh transistor T7. A gate electrode of the seventh transistor T7 may be connected to the Q node Q, a source electrode of the seventh transistor T7 may be connected to a low voltage line, and a drain electrode of the seventh transistor T7 may be connected to the O1-node O1. If the low voltage is applied to the O1-node O1, the seventh transistor T7 may be turned on, and thus may apply the low voltage VL to the O1-node O1. The voltage applied to the O1-node O1 may be delivered to the $k^{th}$ pixel line as the first output signal of the $k^{th}$ stage. The pull-down unit 11 may further include a third capacitor C3. A first electrode of the third capacitor C3 may be connected to the Q node Q, and a second electrode of the third capacitor C3 may be connected to the O1-node O1. The third capacitor C3 may allow the voltage of the Q node Q to be lower than the low voltage VL by bootstrapping when the low voltage VL is applied to O1-node O1, and the seventh transistor T7 may be stably maintained at a turn-on state.

The pull-up unit 12 may include an eighth transistor T8. A gate electrode of the eighth transistor T8 may be connected to the O2-node O2, a source electrode of the eighth transistor T8 may be connected to a high voltage line, and a drain electrode of the eighth transistor T8 may be connected to the O1-node O1. If the low voltage is applied to the O2-node O2, the eighth transistor T8 may be turned on, and thus may apply the high voltage VH to the O1-node O1.

In addition to the fifth transistor T5 and the sixth transistor T6 shown as double-gate type transistors among the transistors included in the $k^{th}$ stage according to an example embodiment of the present disclosure, the first transistor T1, the second transistor T2, the third transistor T3, and the fourth transistor T4 may be implemented as double-gate type transistors, and reliability of the gate driver may be improved.

The $k^{th}$ stage according to the example of FIG. 4 may have a relatively simple circuit that may include eight transistors, and may use two output signals of the $(k-1)^{t}$ stage as input signals. Thus, an area occupied by the stage may be reduced to reduce a bezel area, and an operation margin of the elements included in the stage may be enhanced.

Figure 5:
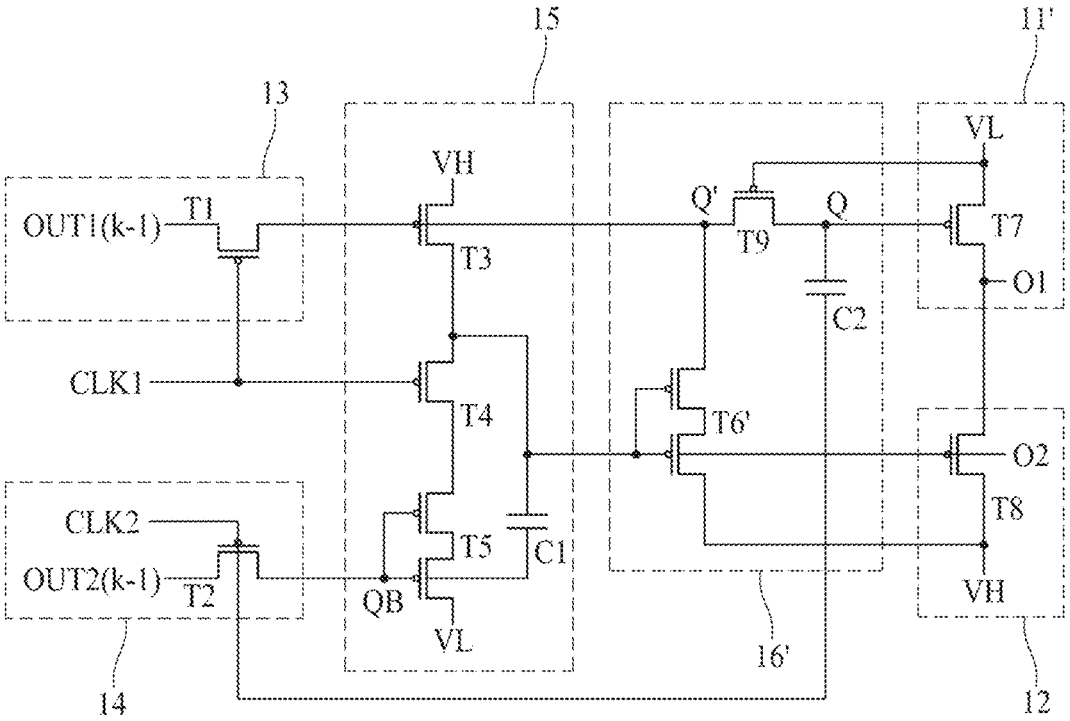
FIG. 5 is a circuit diagram illustrating a stage according to an example embodiment of the present disclosure.

FIG. 5 is a circuit diagram illustrating a stage according to an example embodiment of the present disclosure.

FIG. 5 is a detailed circuit diagram of an example of the block diagram of FIG. 3. The $k^{th}$ stage EM(k) constituting the gate driver 130 will be described as an example with reference to FIG. 5.

In FIG. 5, a ninth transistor T9 is added to the example circuit diagram of FIG. 4, and reliability of the circuit may be improved. Therefore, description of elements repeated with those of FIG. 4 may be omitted or briefly made.

With reference to FIG. 5, the $k^{th}$ stage EM(k) may include a pull-down unit 11', a pull-up unit 12, a Q node controller 13, a QB node controller 14, an O2-node controller 15, and an output signal stabilizer 16'. The pull-up unit 12, the Q node controller 13, the QB node controller 14, and the O2-node controller 15 are substantially similar to those described above.

The output signal stabilizer 16' may include a sixth transistor T6' and a ninth transistor T9. The ninth transistor T9 may be connected to the Q node Q, and may separate the Q node into the Q node Q and Q'-node Q'. Because a gate electrode of the ninth transistor T9 is connected to the low voltage line, the ninth transistor T9 may maintain a turn-on state. A source electrode and a drain electrode of the ninth transistor T9 may be respectively connected to the Q node Q and the Q'-node Q'. As the Q node Q is separated, a drain electrode of the sixth transistor T6' may be connected to the Q'-node Q'. For example, the ninth transistor T9 may be referred to as a "Q node stabilizer."

Degradation may occur in threshold voltages of the third transistor T3 included in the O2-node controller 15, and connected to the Q node Q and the sixth transistor T6' included in the output signal stabilizer 16' more than in the other transistors. To solve this, the ninth transistor T9 may be added to separate the Q node Q. Thus, a degradation level of the threshold voltages of the third transistor T3 and the sixth transistor T6' may be alleviated, and reliability of the gate driver may be improved.

The third capacitor in the FIG. 4 example may be omitted from the pull-down unit 11' of the FIG. 5 example. If the ninth transistor T9 is omitted, a large amount of parasitic capacitance may be formed in the Q node Q. However, as the ninth transistor T9 is added, the Q node Q may be separated, and parasitic capacitance formed in the Q node Q may be reduced. As such, the third capacitor may be omitted.

In addition to the fifth transistor T5 and the sixth transistor T6', shown as double-gate type transistors among the transistors included in the $k^{th}$ stage in the FIG. 5 example, the first transistor T1, the second transistor T2, the third transistor T3 and the fourth transistor T4 may be implemented as double-gate type transistors, and reliability of the gate driver may be improved. The $k^{th}$ stage according to the FIG. 5 example uses two output signals of the $(k-1)^t$ stage as input signals. An area occupied by the stage may be reduced to reduce a bezel area, and an operation margin of the elements constituting the stage may be enhanced.

Figure 6:
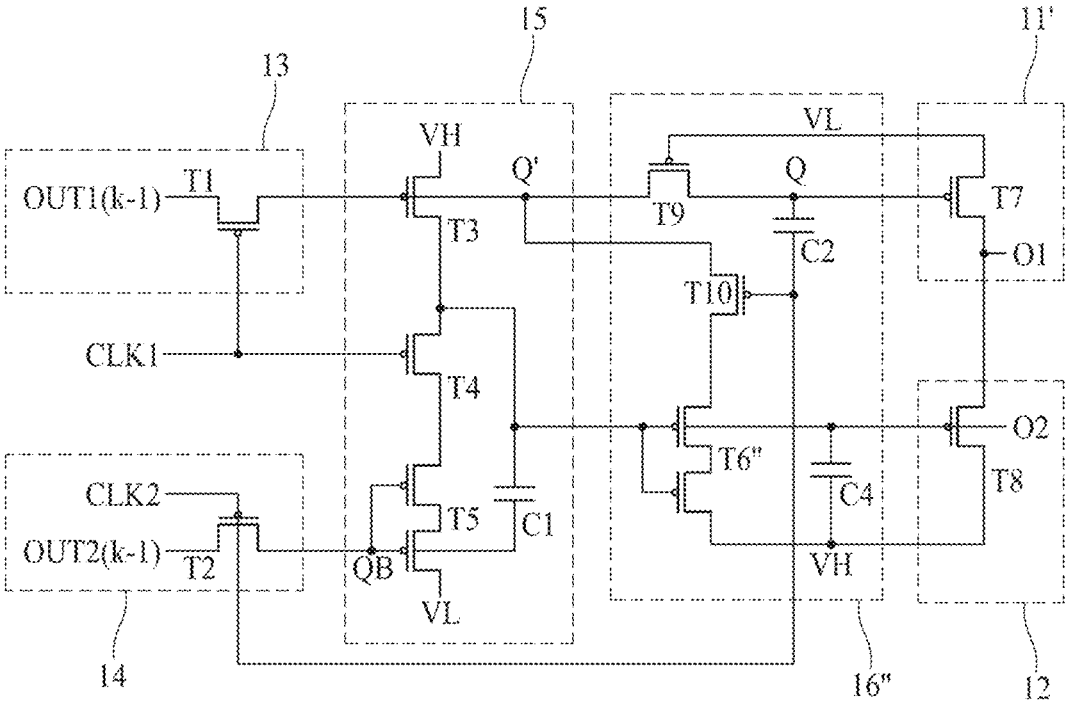
FIG. 6 is a circuit diagram illustrating a stage according to an example embodiment of the present disclosure.

FIG. 6 is a circuit diagram illustrating a stage according to an example embodiment of the present disclosure.

FIG. 6 is a detailed circuit diagram of an example of the block diagram of FIG. 3. The $k^{th}$ stage EM(k) constituting the gate driver 130 will be described as an example with reference to FIG. 6.

In FIG. 6, a tenth transistor T10 may be added to the circuit diagram of the FIG. 5 example. Thus, an operation margin of the transistor may be enhanced, and an impossible operation problem due to a shift of a threshold voltage may be solved. Also, as a fourth capacitor C4 may be additionally provided, a distortion problem of a voltage applied to O1-node O1 may be solved. Hereinafter, description of elements repeated with those of FIG. 4 or FIG. 5 may be omitted or briefly made.

With reference to FIG. 6, the $k^{th}$ stage EM(k) may include a pull-down unit 11', a pull-up unit 12, a Q node controller 13, a QB node controller 14, an O2-node controller 15, and an output signal stabilizer 16". The pull-down unit 11', the pull-up unit 12, the Q node controller 13, the QB node controller 14, and the O2-node controller 15 are substantially similar to those according to the FIG. 5 example.

The output signal stabilizer 16" may include a sixth transistor T6", a ninth transistor T9, a tenth transistor T10, a second capacitor C2, and a fourth capacitor C4. Because the ninth transistor T9 and the second capacitor C2 are substantially similar to those of FIG. 5, their description will be omitted.

A gate electrode of the tenth transistor T10 may be connected to a second clock signal line, a source electrode of the tenth transistor T10 may be connected to a drain electrode of the sixth transistor T6", and a drain electrode of the tenth transistor T10 may be connected to the Q'-node Q'. A gate electrode of the sixth transistor T6" may be connected to the O2-node O2, a source electrode of the sixth transistor T6" may be connected to a high voltage line, and a drain electrode of the sixth transistor T6" may be connected to the source electrode of the tenth transistor T10. The tenth transistor T10 may reduce or prevent collision between the turn-on voltage delivered through the first transistor T1 and the high voltage delivered through the sixth transistor T6" from occurring if the first clock signal CLK is the turn-on voltage. Thus, the first output signal of the $(k-1)^t$ stage through the first transistor T1 may be delivered normally, even though a threshold voltage of the third transistor T3 may be shifted due to degradation of the third transistor T3.

A first electrode of the fourth capacitor C4 may be connected to the O2-node O2, and a second electrode of the fourth capacitor C4 may be connected to the high voltage line. The fourth capacitor C4 may reduce or prevent a voltage of the O2-node O2 from being shifted to the high voltage by the first capacitor C1 when the QB node QB is shifted from the low voltage to the high voltage before the O1-node OQ is shifted from the high voltage to the low voltage, and may maintain the O2-node at a low voltage state and maintain the O1-node O1 at a high voltage state. For example, the tenth transistor T10 and the fourth capacitor C4 may be referred to as "operation margin enhancement portions."

In addition to the fifth transistor T5 and the sixth transistor T6' shown as double-gate type transistors among the transistors included in the $k^{th}$ stage according to the FIG. 6 example, the first transistor T1, the second transistor T2, the third transistor T3, the fourth transistor T4 and the sixth transistor T6" may be implemented as double-gate type transistors. Thus, reliability of the gate driver may be improved.

The $k^{th}$ stage according to the FIG. 6 example may use two output signals of the $(k-1)^{th}$ stage as input signals. Thus, an area reserved by the stage may be reduced to reduce a bezel area, and an operation margin of the elements constituting the stage may be enhanced.

Figure 7:
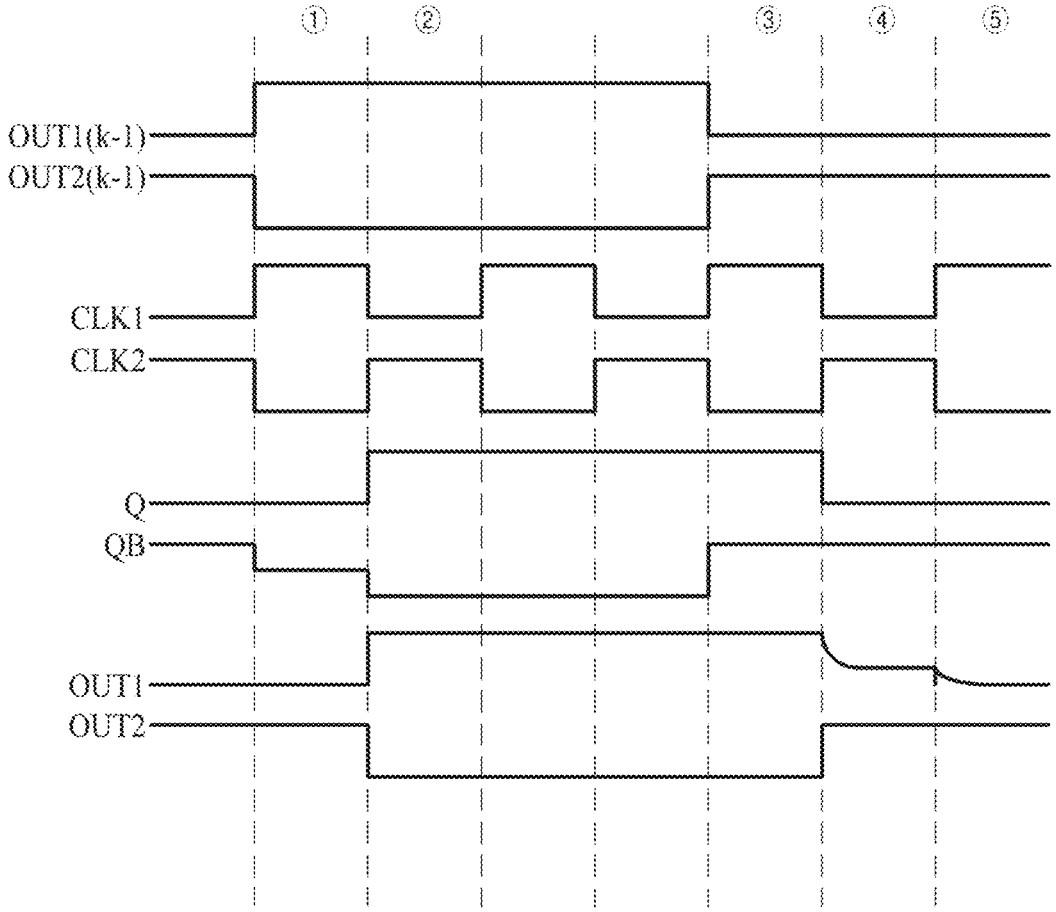
FIG. 7 is a waveform diagram illustrating driving of a stage according to an example embodiment of the present disclosure.

FIG. 7 is a waveform illustrating driving of a stage according to an example embodiment of the present disclosure.

The waveform of FIG. 7 may be equally applied to any of the examples of FIGS. 4-6. With reference to FIGS. 4-7, when the second output signal OUT2($k$−1) of the $(k-1)^t$ stage EM(k−1) and the second clock signal CLK2 correspond to low voltages for a first period ①, the second transistor T2 may be turned on, and the low voltage may be applied to the QB node QB. The fifth transistor T5 may be turned on due to the low voltage applied to the QB node QB, and the low voltage VL may be applied to the drain electrode of the fifth transistor.

When the first clock signal CLK1 corresponds to the low voltage for a second period ②, the first transistor T1 and the fourth transistor T4 may be turned on, the high voltage of the first output signal OUT1($k$−1) of the $(k-1)^{th}$ stage may be applied to the Q node Q, and the low voltage of the drain electrode of the fifth transistor T5 may be applied to the O2-node O2. Because the QB node QB may have a lower voltage than the low voltage due to bootstrapping of the first capacitor C1, the fifth transistor T5 may be stably maintained at a turn-on state. When the eighth transistor T8 is turned on due to the low voltage applied to the O2-node O2, the high voltage may be applied to the O1-node O1. Therefore, the first output signal OUT1 of the $k^{th}$ stage may be the high voltage for the second period ②.

The high voltage and the low voltage may be maintained for four horizontal periods with respect to the first output signal OUT1($k$−1) and the second output signal OUT2($k$−1) of the $(k-1)^{th}$ stage. Therefore, the high voltage and the low voltage may be maintained for the four horizontal periods with respect to the first output signal OUT1 and the second output signal OUT2 of the $k^{th}$ stage.

Additionally, in the examples of FIGS. 4-5, the sixth transistors T6 and T6' may be turned on due to the low voltage applied to the O2-node O2 for three horizontal periods, including the second period ②, and the high voltage may be applied to the Q node Q and the Q'-node Q'. Thus, the first output signal OUT1 may stably output the high voltage. In the FIG. 6 example, the sixth transistor T6" may be turned on due to the low voltage applied to the O2-node O2 for the three horizontal periods, including the second period ②, but the tenth transistor T10 may be turned on only when the second clock signal CLK2 corresponds to the low voltage. The high voltage may be intermittently applied to the Q'-node Q'.

For a third period®, when the second output signal OUT2($k$−1) of the $(k-1)^{th}$ stage is shifted to the high voltage, and the second clock signal CLK2 corresponds to the low voltage, the high voltage may be applied to the QB node QB. The fifth transistor T5 may be turned off.

For a fourth period®, when the first output signal OUT1 ($k$−1) of the $(k-1)^{th}$ stage and the first clock signal CLK1 correspond to the low voltage, the first transistor T1 may be turned on, and may thus apply the low voltage to the Q node Q. Therefore, the third transistor T3 may be turned on, and may thus apply the high voltage to the O2-node O2. The high voltage may turn off the eighth transistor T8, and may be input to the $(k+1)^{th}$ stage as the second output signal OUT2 of the $k^{th}$ stage. Also, when the seventh transistor T7 is turned on by the low voltage applied to the Q node Q, the low voltage may be applied to the O1-node O1. For example, a complete low voltage may not be applied to the O1-node O1 due to a threshold voltage value of the seventh transistor T7. This may be compensated by the second capacitor C2 for a fifth period ⑤.

For the fifth period ⑤, the second clock signal CLK2 may be shifted to the low voltage, the voltage of the Q node Q may be stably shifted to the low voltage due to bootstrapping of the second capacitor C2, the second transistor T7 may be maintained at a turn-on state, and the low voltage may be applied to the O1-node O1. The voltage applied to the O1-node O1 may be applied to the $k^{th}$ pixel line as the first output signal OUT1 of the $k^{th}$ stage.

According to an example embodiment of the present disclosure, a stage may use two signals output from a previous stage as start signals, an area reserved by the stage may be reduced to reduce a bezel area, and an operation margin of elements constituting the stage may be enhanced. According to an example embodiment of the present disclosure, transistors connected to both ends of a capacitor may be double-gate type transistors, and reliability of a circuit constituting the stage may be improved.

According to an example embodiment of the present disclosure, a Q node that controls a pull-down transistor may be separated using a transistor, and parasitic capacitance formed in the Q node may be reduced. Thus, a capacitor may be omitted from a pull-down unit.

According to an example embodiment of the present disclosure, a tenth transistor may be between Q' node and a sixth transistor to avoid collision between a turn-on voltage transferred through a first transistor and a high voltage transferred through the sixth transistor if a first clock signal is the turn-on voltage. Thus, a signal input through the first transistor may be transferred normally even if a threshold voltage is shifted due to degradation of a third transistor.

According to an example embodiment of the present disclosure, a fourth capacitor connected between a second output signal line and a high voltage line may reduce or prevent a voltage of a second output signal from being shifted to a high voltage by a first capacitor when QB node is shifted from a low voltage to a high voltage before a first output signal is shifted from a high voltage to a low voltage, and may maintain the second output signal at a low voltage state to maintain the first output signal at a high voltage state.

A gate driver and a electroluminescence display device according to an example embodiment of the present disclosure may be described as follows.

According to an embodiment of the present disclosure, an electroluminescence display device may include: an emission line, subpixels connected to the emission line, and an emission driver configured to supply an emission signal to the emission line, the emission driver including a plurality of stages, a $k^{th}$ stage, among the plurality of stages, including: a first output node connected to the emission line, a second output node, a Q node, a pull-down circuit and a pull-up circuit respectively controlled by the Q node and the second output node, the pull-down circuit and the pull-up circuit being configured to provide a voltage to the first output node, a first controller configured to receive a voltage of a first output node of a $(k-1)^{t}$ stage or a first start signal, a second controller configured to receive a voltage of a second output node of the $(k-1)^{th}$ stage or a second start signal, a third controller configured to control the voltage of the second output node, and a fourth controller configured to be controlled by the second output node. 'k' may be a natural number of 1 or more.

For example, in the electroluminescence display device according to an embodiment of the present disclosure, the fourth controller further may include a Q node stabilizer configured to separate the Q node into a primary Q node and a Q'-node. For example, in the electroluminescence display device according to an embodiment of the present disclosure, the fourth controller further may include an operation margin enhancement portion configured to reduce or prevent collision between voltages the fourth controller.

For example, in the electroluminescence display device according to an embodiment of the present disclosure, the third controller further may include a capacitor, and at least one transistor connected to the capacitor may be in each of the third controller and the fourth controller, the at least one transistor being a double-gate type transistor. For example, in the electroluminescence display device according to an embodiment of the present disclosure, the pull-down circuit may include a capacitor connected to the Q node and the first output node. For example, in the electroluminescence display device according to an embodiment of the present disclosure, the first controller may be further configured to be controlled by a first clock signal, the second controller may be further configured to be controlled by a second clock signal, and the first clock signal and the second clock signal swing between a low voltage and a high voltage at a cycle of one horizontal period and have their respective phases opposite to each other.

For example, in the electroluminescence display device according to an embodiment of the present disclosure, the fourth controller may include: a T6 transistor configured to be controlled by the second output node and connected to the Q node, a T9 transistor connected to the Q node, configured to separate the Q node into a primary Q node and a Q'-node, and a C2 capacitor connected to the Q node and a second clock signal line. For example, in the electroluminescence display device according to an embodiment of the present disclosure, the fourth controller further may include: a T10 transistor configured to be controlled by a second clock signal and connected to the Q node and the T6 transistor, a C4 capacitor connected to the second output node and the high voltage line.

According to an embodiment of the present disclosure, a gate driver may include: a plurality of stages, a $k^{th}$ stage, among the plurality of stages, including: a first output node, a second output node, a pull-down transistor and a pull-up transistor configured to control the first output node, a controller configured to control the second output node, the controller including: a T3 transistor configured to be controlled by a Q node, a T4 transistor configured to be controlled by a first clock signal, a T5 transistor configured to be controlled by a QB node, and a first capacitor including: a first electrode connected to the QB node, and a second electrode connected to the second output node, and an output signal stabilizer connected to the Q node and the second output node, wherein voltages applied to the first output node and the second output node may be applied as start signals of a $(k+1)^{th}$ stage, and wherein k may be a natural number of 1 or more.

For example, in the gate driver according to an embodiment of the present disclosure, the T5 transistor may be a double-gate type transistor. For example, in the gate driver according to an embodiment of the present disclosure, the $k^{th}$ stage further may include: a T1 transistor configured to control a voltage of the Q node, and a T2 transistor configured to control a voltage of the QB node, the T1 transistor may be connected to a first output node of the $(k-1)^{th}$ stage, and the T2 transistor may be connected to a second output node of the $(k-1)^{th}$ stage.

For example, in the gate driver according to an embodiment of the present disclosure, the $k^{th}$ stage may include: a T6 transistor, in the output signal stabilizer, connected to the Q node and configured to be controlled by the second output node, and a second capacitor connected to the Q node and a second clock signal line. For example, in the gate driver according to an embodiment of the present disclosure, the pull-down transistor and the T5 transistor may be connected to a low voltage line, and the pull-up transistor, the T3 transistor, and the T6 transistor may be connected to a high voltage line. For example, in the gate driver according to an embodiment of the present disclosure, the T6 transistor may be a double-gate type transistor.

For example, in the gate driver according to an embodiment of the present disclosure, the $k^{th}$ stage may include a third capacitor connected to the Q node and the first output node. For example, in the gate driver according to an embodiment of the present disclosure, the $k^{th}$ stage may include: a T6 transistor, in the output signal stabilizer, configured to be controlled by the second output node and connected to the Q node, a T9 transistor connected to the Q node, configured to separate the Q node into a primary Q node and a Q'-node, and a second capacitor connected to the Q node and a second clock signal line.

For example, in the gate driver according to an embodiment of the present disclosure, the pull-down transistor, the T5 transistor, and the T9 transistor may be connected to a gate low voltage line, and the pull-up transistor, the T3 transistor, and the T6 transistor may be connected to a gate high voltage line. For example, in the gate driver according to an embodiment of the present disclosure, the T6 transistor may be a double-gate type transistor.

For example, in the gate driver according to an embodiment of the present disclosure, the $k^{th}$ stage may include, in the output signal stabilizer: a T9 transistor connected to the Q node, configured to separate the Q node into a primary Q node and a Q'-node, a T6 transistor configured to be controlled by the second output node, a T10 transistor configured to be controlled by a second clock signal and connected to the Q node and the T6 transistor, a second capacitor connected to the second clock signal line configured to receive the Q node and the second clock signal may be input, and a fourth capacitor connected to the second output node and the high voltage line. For example, in the gate driver according to an embodiment of the present disclosure, the pull-down transistor, the T5 transistor, and the T9 transistor may be connected to a gate low voltage line, and the pull-up transistor, the T3 transistor, and the T6 transistor may be connected to a gate high voltage line. For example, in the gate driver according to an embodiment of the present disclosure, the T6 transistor may be a double-gate type transistor.

It will be apparent to those skilled in the art that various modifications and variations may be made in the present disclosure without departing from the technical idea or scope of the disclosure. Thus, it may be intended that embodiments of the present disclosure cover the modifications and variations of the disclosure provided they come within the scope of the appended claims and their equivalents.

What is claimed is:

1. A gate driver, comprising:

a plurality of stages, a $k^{th}$ stage, among the plurality of stages, comprising:

a first output node connected to an emission line;

a second output node;

a Q node connected to a first controller and a pull-down circuit;

the pull-down circuit and a pull-up circuit respectively controlled by the Q node and the second output node, the pull-down circuit and the pull-up circuit being configured to provide a voltage to the first output node, the pull-down circuit including a pull-down transistor and the pull-up circuit including a pull-up transistor;

the first controller configured to receive a voltage of a first output node of a $(k-1)^{th}$ stage, among the plurality of stages, or a first start signal;

a second controller configured to receive a voltage of a second output node of the $(k-1)^t$ stage or a second start signal;

a third controller configured to control the voltage of the second output node; and a fourth controller configured to be controlled by the second output node and to control the voltage of the first output node, wherein the third controller comprises:

a T3 transistor configured to be controlled by the Q node, a T4 transistor configured to be controlled by a first clock signal, a T5 transistor configured to be controlled by a QB node, and a first capacitor comprising:

a first electrode connected to the QB node, and a second electrode connected to the second output node, wherein the fourth controller comprises:

an output signal stabilizer connected to the Q node and the second output node, and a T9 transistor, wherein voltages applied to the first output node and the second output node are applied as start signals of a $(k+1)^{th}$ stage, wherein the $k^{th}$ stage further comprises:

a T1 transistor configured to control a voltage of the Q node, and a T2 transistor configured to control a voltage of the QB node, wherein the T1 transistor is connected to the first output node of the $(k-1)^{th}$ stage, and wherein the T2 transistor is connected to the second output node of the $(k-1)^{th}$ stage, wherein the T9 transistor is connected to the pull-down transistor via the Q node and the first transistor via a Q'-node, and wherein k is a natural number equal to or greater than 1.

2. The gate driver of claim 1, wherein the T5 transistor is a double-gate type transistor.

3. The gate driver of claim 1, wherein the $k^{th}$ stage further comprises:

a T6 transistor, in the output signal stabilizer, connected to the Q node and configured to be controlled by the second output node; and a second capacitor connected to the Q node and a second clock signal line.

4. The gate driver of claim 3, wherein:

the pull-down transistor and the T5 transistor are connected to a low voltage line; and the pull-up transistor, the T3 transistor, and the T6 transistor are connected to a high voltage line.

5. The gate driver of claim 3, wherein the T6 transistor is a double-gate type transistor.

6. The gate driver of claim 1, wherein the $k^{th}$ stage further comprises a third capacitor connected to the Q node and the first output node.

7. The gate driver of claim 1, wherein the $k^{th}$ stage further comprises:

a T6 transistor, in the output signal stabilizer, configured to be controlled by the second output node and connected to the Q node; and a second capacitor connected to the Q node and a second clock signal line.

8. The gate driver of claim 7, wherein:

the pull-down transistor, the T5 transistor, and the T9 transistor are connected to a gate low voltage line; and the pull-up transistor, the T3 transistor, and the T6 transistor are connected to a gate high voltage line.

9. The gate driver of claim 7, wherein the T6 transistor is a double-gate type transistor.

10. The gate driver of claim 1, wherein the $k^{th}$ stage further comprises, in the output signal stabilizer:

a T6 transistor configured to be controlled by the second output node;

a T10 transistor configured to be controlled by a second clock signal and connected to the Q node and the T6 transistor;

a second capacitor connected to the second clock signal line, the second capacitor being configured to receive the Q node and the second clock signal; and a fourth capacitor connected to the second output node and the high voltage line.

11. The gate driver of claim 10, wherein:

the pull-down transistor, the T5 transistor, and the T9 transistor are connected to a gate low voltage line; and the pull-up transistor, the T3 transistor, and the T6 transistor are connected to a gate high voltage line.

12. The gate driver of claim 10, wherein the T6 transistor is a double-gate type transistor.

* * * * *